United States Patent [19]

Harpold et al.

[11] Patent Number: 5,020,430

[45] Date of Patent: Jun. 4, 1991

[54] PRINTER

[75] Inventors: Charles W. Harpold; James Belcher, both of Grand Rapids, Mich.

[73] Assignee: Harco Graphic Products, Inc., Grand Rapids, Mich.

[21] Appl. No.: 346,068

[22] Filed: May 2, 1989

[51] Int. Cl.[5] ..... B41F 15/26

[52] U.S. Cl. ..... 101/126; 101/115

[58] Field of Search ..... 101/114, 115, 126

[56] References Cited

U.S. PATENT DOCUMENTS

| | | | |
|---|---|---|---|
| 3,299,804 | 1/1967 | Schueler | 101/35 |
| 3,641,930 | 2/1972 | Riddington | 101/35 |
| 4,031,825 | 6/1977 | Jaffa | 101/126 |
| 4,084,504 | 4/1978 | Fuchs | 101/115 |
| 4,669,378 | 6/1987 | Lee | 101/115 |
| 4,750,419 | 6/1988 | Meredith | 101/126 |
| 4,920,878 | 5/1990 | Harpold et al. | 101/115 |
| 4,949,635 | 8/1990 | Padula | 101/115 |

*Primary Examiner*—Edgar S. Burr
*Assistant Examiner*—Ren Yan
*Attorney, Agent, or Firm*—Price, Heneveld, Cooper, DeWitt & Litton

[57] ABSTRACT

A silk screen printing machine having a track about which the printing screens and platens are free to be moved relative to one another in the course of a multi-step printing process. An embodiment is disclosed having the printing screens supported by spokes and platens manually rotatable about a circular supporting track without supporting spokes. The platens move on a common horizontal plane below the printing screens which are brought down onto the platens for screen printing.

15 Claims, 2 Drawing Sheets

PRINTER

BACKGROUND OF THE INVENTION

In the screen printing art, it has been common practice in the past to have multi positioned screen printing machines with both the platens for supporting the workpiece and the print screen support arms radiating and supported from a central hub. The assignee of the present invention currently markets a line of such screen printing machines. Each of these machines is manually operated with the print screens and workpiece supporting platens being moved relative to one another and being manually brought into registration for printing.

One drawback to the rotary printer is that it is difficult to locate very many platens and screens, especially for printing larger items around the central hub. As the number of platens and screens increases or as the size thereof increases, the structural requirements imposed on the central hub and the radiating support arms become significant.

In order to speed up the screen printing process, automatic machines have been devised in which the printing screens are at permanent positions associated with ink supplies and squeegees and the platens move about a track and are brought to each printing station if multiple images are to be applied to each workpiece or if a composite image is to be made. The assignee of the present application also manufactures and sells such automatic screen printing machines. The previously described machines do an excellent job of screen printing within their capability, for example, the hub supported manual machine being well suited for small orders and the automatic machine being well suited for large orders. Both of the machines suffer to some extent in being limited by the size of the print screens and workpieces that can be handled. For example, the previously described machines are excellent to produce screen printed T-shirts and sweatshirts. On the other hand, both machines would have to be modified to handle a workpiece as large as, for example, a large beach towel or any workpiece upon which a large image was to be printed.

SUMMARY OF THE INVENTION

In accordance with the teaching of the present invention, a screen printing machine is disclosed which is well suited for handling extremely large workpieces and large silk screen images in either a single or multi image printing format.

The screen printing machine has a closed track about which carriers for supporting printing screens and carriers for supporting platens can be moved relative to one another to permit multiple images or composite images to be printed upon workpieces supported by the platens. The screen printing machine can handle a rang of sizes of workpieces and images for printing but is particularly suitable for workpieces and images too large for currently known multiple station screen printing machines. The weight of the screens and platens is essentially supported by the track means, eliminating the need for a large structural hub and heavy structural cantilever support arms.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE PREFERRED EMBODIMENT

Figure 1:
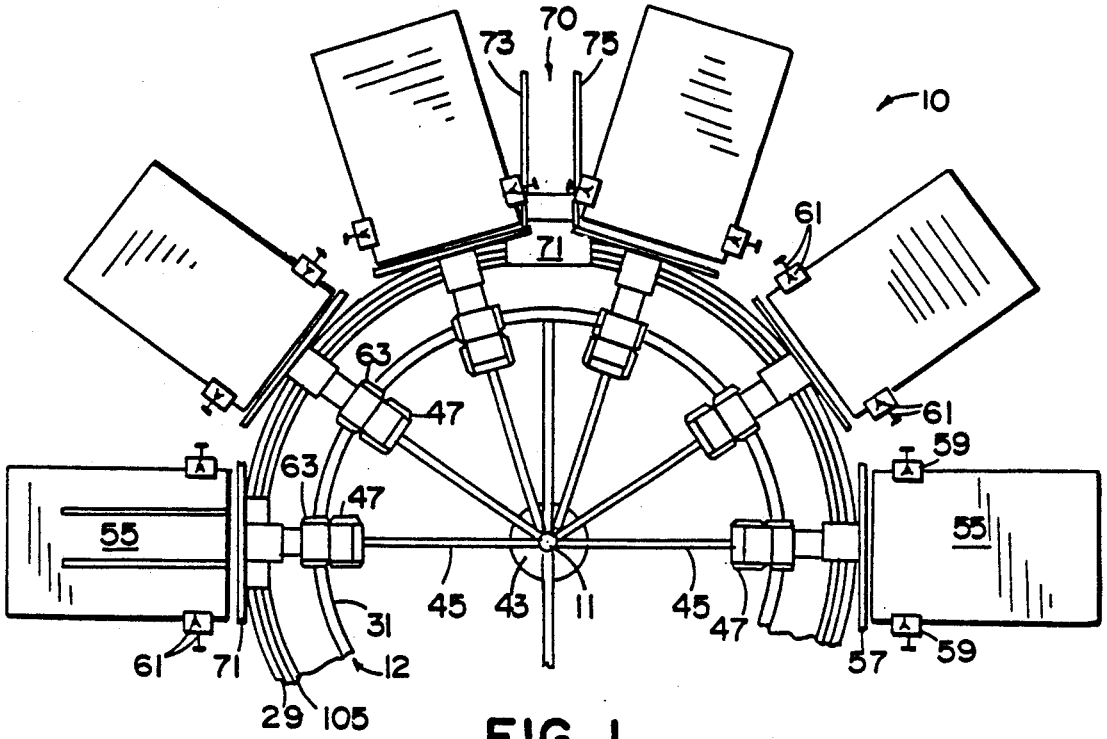
FIG. 1 is a partial top plan view of an embodiment of the rotary screen printer of the present invention.

FIG. 1 shows a partial top plan view of the rotary embodiment printer of the present invention. Only a partial view is shown since the full view would merely complete the circular path shown in the figure. The rotary printer 10 has a center support 11 about which is positioned a circular track indicated generally by the number 12. The track 12 is made of three circular steel tubes each of which can be from 1 to 2 inches in diameter depending on the size of the circular track and the length of unsupported sections. The track can be assembled from four arcuate sectors which are joined together to form a completed circle. In joining the track sections, the end of one sector can be made to telescope into the mating piece or, and more preferred, a small section of tubing of the proper diameter to fit smoothly into each section of track is used. The smaller tube is slipped into one section and bolted in place. The next section is then slipped over the free end and bolted in place to form a smooth reinforced splice in the track. It is also possible to use a suitable fixture or jig and weld the track sections together. Welding is useful if the machine is not too large to make moving or dismantling extremely difficult. About the circle are provided a plurality of supports and spacers for the track.

Figure 2:
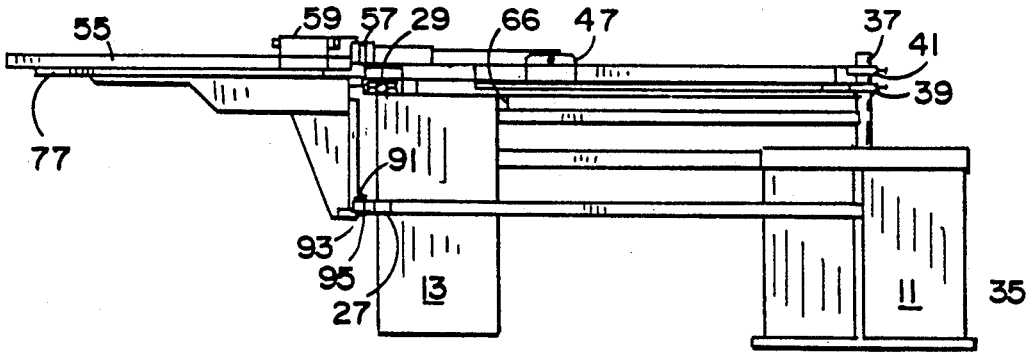
FIG. 2 is an elevational view of one printing station of the embodiment of FIG. 1 showing a printing screen lowered into position above a platen.
Figure 5:
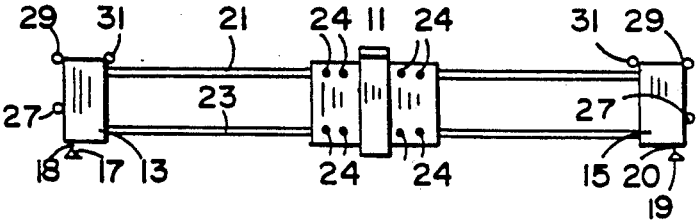
FIG. 5 shows a sectional view of the central hub and end braces with adjustable support feet to level the track.

In FIG. 2, an end brace 13 is shown which provides contact with the floor of the printing shop and which also supports the three tubes making up the circular ring. Referring to FIG. 5, end braces 13 and 15 are shown spaced from the center support 11. Each of the end braces is provided with an adjustable foot 17 and 19 for leveling the basic frame of the machine. The feet 17 and 19 are supported on threaded shafts 18 and 20 which are adapted to be screwed into a threaded aperture in the bottom of each end brace. The foot support can also be mounted to an inside or outside edge of the end brace. The end braces 13 and 15 are joined to the center hub 11 by spaced braces 21 and 23. The braces 21 and 23 are made of rectangular tubular steel. One end of each of the horizontal braces 21 and 23 is bolted to the end braces 13 and 15. The opposite ends telescope within spaced mating rectangular recesses in the center hub 11. The length of the braces can be adjusted in this manner. Bolts 24 are used to compress against the rectangular steel tube to hold it in position in the center support 11. Not shown in FIG. 5 are the transverse end braces and horizontal braces making up the complete basic frame of the rotary printer. Each end brace supports the steel tubular members 27, 29, and 31. It can be seen then that in adjusting the basic frame the track 12 is also adjusted.

Figure 4:
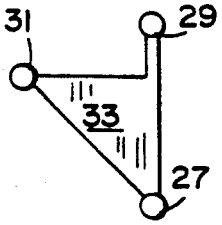
FIG. 4 is an elevational view of a track brace and spacer.

In order to stabilize the track between the end braces, spacers 33 are provided. Referring to FIG. 4, in the preferred embodiment, there are two spacers 33 joining the three pieces of tubular steel making up the track between each end brace. The number of braces is dependent on the size of the circle with more spacers being used if the circle is increased in size and less being needed if the circle is smaller. In the preferred embodiment disclosed herein, the circle is 10 feet in diameter. There are, then, end braces supporting the track spaced at 90-degree intervals about the track and with two track spacers 33 equally spaced between the end braces and joined to the three pieces of track to maintain the spacing of the track and to provide reinforcement.

Referring again to FIGS. 1, 2, and 3, the center support 11 has a base plate 35 for resting on the floor of the work shop or printing shop. Centrally located on the top of the support 11 is an axial shaft 37 the central axis of which forms the base line for all longitudinal measurements in the rotary embodiment of the screen printing machine. A locking hub 39 supports a bearing 41 centrally located in the hub 43. The hub 43 supports the end of each of the identical spokes 45. The spokes 45 are bolted to the hub 43 in order to firmly fix their position relative to the center of the rotary printer and in turn establish the longitudinal positioning for all printing. Each of the spokes 45 is manufactured from rectangular tubular steel similar to that used for the basic frame members 21 and 23.

Figure 3:
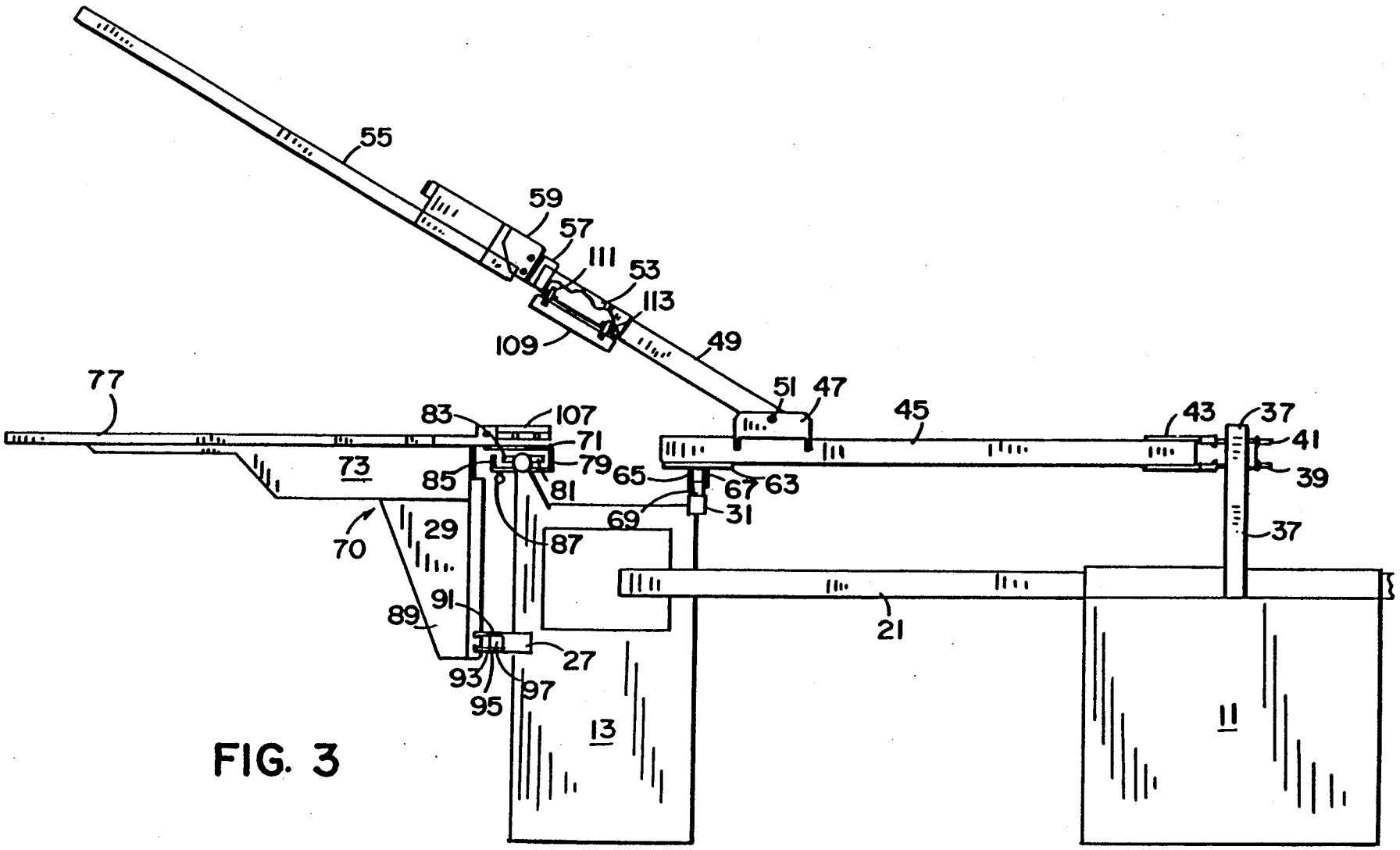
FIG. 3 is a side elevational view of an embodiment of a rotary printer of the present invention showing a spoke connected to the print screen holder and with the platen holder being supported by the guide rails.

At the remote end of each spoke 45, there is mounted a pivoting head support plate 47. The pivoting head support plate consists of a flat plate having opposed upturned edges. The plate can be bolted or welded to the spoke 45. Referring to FIG. 3, the pivoting head support plate 47 supports an arm 49 which is pivotally attached to the head support plate by a suitable pin 51 which passes through the spaced upturned edges of the support plate and through the arm 49. The arm 49 is of an open box-like configuration having a flat top surface and turned down opposed edges which fit within the turned-up edges of pivot head support plate 47. The arm is made to be very rigid to support the mass of the print screen. At the end of the arm 49 is attached the print screen support 53 which is used to support and align the print screen 55. As shown in FIG. 1, the print screen support 53 has a base 57 which abuts and supports the screen. On either side and fastened to the piece 57 are adjustable clamps 59 which are equipped with hand-operated screen registration knobs 61 which permit front-to-back and side-to-side adjustment of the printing screen.

On the bottom of each spoke 45 near the end remote from the axial shaft 37 is positioned a plate 63 which supports two spaced flanges 65 and 67 which support an axle 66 (see FIG. 2) which in turn supports a wheel 69 which rotates about the printer on the tube 31. As shown in FIG. 3, the tube 31 is of square configuration. All of the tubes used in forming the track of the rotary printer can either be of circular or square configuration. In the larger machines, it is preferred to use circular track which is prepared in sections and then joined to complete the track. In smaller machines, square tubular sections are joined. The upper surface of the tube 31 provides a surface for the wheel 67 to roll upon as the print screen support arm and print screen is manually moved about the rotary printer.

In the embodiment of the invention illustrated in FIG. 1, six print screen locations are shown. Additional print screen locations can be added if desired and in a 10 foot diameter embodiment, for example, ten different print screens can be used. The embodiments discussed are for example only and not meant to be a limitation on the number of print screens and platens which can be used.

The disclosed rotary printer is adapted to support several platens holding workpieces on which printing is to be done. Referring to FIGS. 1 and 3, a platen carriage 70 is shown. The platen carriage has an upper support plate 71 to which are attached spaced platen-supporting arms 73 and 75. The supporting arms are spaced approximately 18 to 20 inches apart and are adapted to support a platen 77 upon which workpieces to be printed can be mounted. The platen carriage is supported on the track 29 by two sets of spaced "V" wheels mounted near each end of the plate 71. A metal plate 79 is fastened to the bottom of the plate 71. The plate 79 has a downward and turned-in edge which supports the vertical axle about which "V" wheel 81 rotates. On the opposite side of track 29 is an identical "V" wheel 83 which is supported on an adjustable plate 85. The plate 85 allows the "V" wheel 83 to be moved away from the track 29 when attaching or removing the platen carriage 70 and to be moved back in contact with the track and to be clamped by a bolt 87. At each end of the platen carriage is mounted a depending brace 89 for supporting members 73 and 75. Near the inner edge of brace 89 is mounted a pair of flanges 91 and 93 which support an axle 95 upon which a wheel 97 is mounted which rotates against track member 27. The platen carriage is clamped to and supported by the "V" wheels 81 and 83 and the tube 29. It is braced by member 89 and is facilitated in its movement about the circular track by the wheel 97 rolling on the face of the square tube 27. In a preferred embodiment of the invention, four platen carriages 70 are mounted on the track 12 and are joined together by tubular sectors so that the four can move in unison in relation to the print screens. While in the preferred embodiment "V" wheels have been used to support the platen carriages, in other embodiments, the "V" wheels can be replaced by circular wheels which apply the same four points of contact to the tubular track. It is also possible in a much simpler form of the present invention to use polymeric bushings such as nylon or Teflon to grip the track and support the platen carriage.

Referring to FIG. 3, the workpiece supporting platen 77 is fastened to the platen carriage plate 71 which supports printing registration blocks 107 of the type commonly used by the assignee of the present invention in many different silk screen printing machines. For example, see U.S. Pat. application Ser. No. 189,728 filed May 3, 1988, assigned to the same assignee as the instant application and incorporated herein by reference. The registration blocks consist of two spaced elongated steel blocks. The spaced blocks are positioned approximately one inch apart and are fastened to the back of the platen carriage. On the bottom of the print screen supporting arm 49, a mating single block 109 is fastened which, on depression of the print screen, will register between the two fixed blocks 107 on the platen carriage to bring the print screen and the platen into alignment for printing to take place.

While the registration means is similar in overall appearance to that used in many applications, in the rotary printer, an important change was made in that the upper registration block is fastened to the print screen support arm by two bolts 111 and 113 which are screwed into the back of the registration block through the bottom of the print screen support arm. In order to compensate for any misalignment or offset in the two circles used in the rotary printer, that is, the circle for the print screen and the circle for the platens; it was found desirable to provide some movement in the center registration block. By allowing a small amount of movement of the center registration block, it was found possible to accurately register the print screen and platen and compensate for any offset in the circles of operation of the rotary printer.

In the operation of the rotary printer, it is possible to position different sized print screens and different sized platens depending on the size or shape of the article to be printed upon. It is also possible to use different print screens and platens for different types of articles so that the rotary printer can be used to produce different types of articles in a single operation. For example, it is possible to have a platen supporting a jacket, another a T-shirt, another a tablecloth, and another a beach towel and move different print screens to these various platens or move one print screen with a single image desired on each one of the articles over the several platens. It is obvious that the rotary printer is adaptable to many different types and combinations of silk screen printing applications.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. A machine for screen printing comprising:

a plurality of support tracks;

at least one printing head support member disposed on at least one of said tracks;

a print screen support arm pivotally mounted at one end on each of said printing head support members;

a clamp for supporting a printing screen terminating the distal end of said print screen support arm remote from said pivot so that a printing screen, when in place, can be lowered into position for printing or moved along said track;

a platen carriage disposed on at least one of said tracks other than the track supporting said printing head support member;

a platen supporting arm extending from said platen carriage so that a platen, when in place, can be moved along said track and so that the platens and printing screens can be brought into registration for screen printing by moving the platens or printing screens.

2. A screen printing machine as set forth in claim 1 wherein a print registration means is provided for aligning each printing screen and platen prior to printing.

3. A screen printing machine as set forth in claim 2 wherein a part of the print registration means is provided on said print screens support arm and the coacting part of the print registration means is provided on said platen carriage.

4. A screen printing machine as set forth in claim 3 wherein the registration means on said print screen support arm is an elongated metal block and the coating part of the print registration means is a pair of spaced elongated blocks on said platens carriage adapted to receive therebetween the elongated block on the print screen support arm to align the print screen and platen.

5. A screen printing machine as set forth in claim 4 wherein the elongated registration block on the print screen support arm is adapted to move relative to said arm during the registration process to compensate for misalignment of the printing screen and platen circles of rotation.

6. A screen printing machine comprising:

a plurality of circular tracks;

a moveable member supported by at least one of said circular tracks;

a pivoting head support member attached to said moveable member;

a print screen support arm pivotally mounted at one end on each of said pivoting head support members;

a clamp for supporting a print screen terminating the distal end of said print screen support arm remote from said pivot so that a printing screen, when in place, can be lowered into position for printing or raised for movement about said circular track;

a platen carriage disposed on at least one of said circular tracks other than the track supporting said moveable member;

at least one platen-supporting arm extending from said platen carriage so that a platen, when in place, can be moved about said circular tracks and so that a platen and a printing screen can be brought into registration for screen printing by moving the platen or the printing screen.

7. A screen printing machine as set forth in claim 10 having a plurality of platen carriages joined by a plurality of arcuate sectors into a continuous ring adapted to move all of the platens about said circular track at one time.

8. A screen printing machine as set forth in claim 10 wherein a print registration means is provided for aligning each printing screen and platen prior to printing.

9. A screen printing machine as set forth in claim 12 wherein a part of the print registration means is provided on said print screens support arm and the coacting part of the print registration means is provided on said platen carriage.

10. A screen printing machine as set forth in claim 9 wherein the registration means on said print screen support arm is an elongated metal block and the coacting part of the print registration means is a pair of spaced elongated blocks on said platens carriage adapted to receive therebetween the elongated block on the print screen support arm to align the print screen and platen.

11. A screen printing machine as set forth in claim 10 wherein the elongated registration block on the print screen support arm is adapted to move relative to said arm during the registration process to compensate for misalignment of the printing screen and platen circles of rotation.

12. A screen printing machine as set forth in claim 6 wherein said platen carriage grips at least one track of said plurality of tracks and is rollingly biased against another one of said plurality of tracks.

13. A screen printing machine as set forth in claim 12 wherein spaced "V" wheels are used to grip said at least one track of said plurality of tracks and enable said platen carriage to roll around said plurality of tracks.

14. A screen printing machine as set forth in claim 12 wherein spaced wheels are provided on said platen carriage to grip said track.

15. A screen printing machine as set forth in claim 12 wherein bushings are provided on said platen carriage to grip said track.

* * * * *

UNITED STATES PATENT AND TRADEMARK OFFICE

CERTIFICATE OF CORRECTION

PATENT NO. : 5,020,430

DATED : June 4, 1991

INVENTOR(S) : Charles W. Harpold et al.

It is certified that error appears in the above-identified patent and that said Letters Patent is hereby corrected as shown below:

Column 1, line 57:
"rang" should be --range--;

Column 6, claim 7, line 37:
"10" should be --6--;

Column 6, claim 8: line 42:
"10" should be --6--;

Column 6, claim 9, line 45:
"12" should be --8--.

Signed and Sealed this

Eighth Day of December, 1992

*Attest:*

DOUGLAS B. COMER

*Attesting Officer*

*Acting Commissioner of Patents and Trademarks*